US008923525B2

(12) United States Patent
Saideh

(10) Patent No.: US 8,923,525 B2
(45) Date of Patent: Dec. 30, 2014

(54) POWER TRANSFERRING HEADPHONES

(71) Applicant: Zeikos Inc., New York, NY (US)

(72) Inventor: Isaac Saideh, Brooklyn, NY (US)

(73) Assignee: Zeikos Inc., New York, NY (US)

( * ) Notice: Subject to any disclaimer, the term of this patent is extended or adjusted under 35 U.S.C. 154(b) by 4 days.

(21) Appl. No.: 14/071,223

(22) Filed: Nov. 4, 2013

(65) Prior Publication Data

US 2014/0219466 A1 Aug. 7, 2014

Related U.S. Application Data

(63) Continuation of application No. 13/760,765, filed on Feb. 6, 2013.

(51) Int. Cl.
*H04R 1/10* (2006.01)

(52) U.S. Cl.
CPC ..... *H04R 1/1041* (2013.01); *H04R 1/1033* (2013.01); *H04R 2420/09* (2013.01); *H04R 2460/03* (2013.01)
USPC ..... 381/74; 381/309; 381/370; 381/384; 381/55

(58) Field of Classification Search
CPC .... H04R 5/033; H04R 1/1041; H04B 1/3883; H04B 1/3877; Y02E 60/12; H02J 7/0054; H02J 7/0044
USPC ..... 381/74, 309, 370, 384, 123, 55, 311; 455/573, 571, 572; 320/103, 114
See application file for complete search history.

(56) References Cited

U.S. PATENT DOCUMENTS

| | | | |
|---|---|---|---|
| 5,164,652 | A | 11/1992 | Johnson et al. |
| 5,254,931 | A | 10/1993 | Martensson |
| 5,333,177 | A | 7/1994 | Braitberg et al. |
| 5,350,993 | A | 9/1994 | Toya et al. |
| 5,369,352 | A | 11/1994 | Toepfer et al. |
| 5,420,496 | A | 5/1995 | Ishikawa |
| 5,506,490 | A | 4/1996 | DeMuro |
| 5,534,765 | A | 7/1996 | Kreisinger et al. |

(Continued)

FOREIGN PATENT DOCUMENTS

| | | |
|---|---|---|
| GB | 2418546 | 3/2006 |
| WO | 9819223 | 5/1998 |
| WO | 2006116298 | 11/2006 |
| WO | 2011150381 | 12/2011 |

OTHER PUBLICATIONS

JJR Acoustics, LLC, "Headphones," Product Design Specification, Version 1.3, Oct. 11, 2012.

(Continued)

*Primary Examiner* — Paul S Kim
(74) *Attorney, Agent, or Firm* — Amster, Rothstein & Ebenstein LLP

(57) ABSTRACT

The invention relates to headphones which can facilitate the transfer of electrical power from the headphones' internal power source to other devices. A pair of headphones can connect to a device through a modified cable. The modified cable triggers the transfer of electrical power to the device. A pair headphones may have a modified port which, when connected to the device through a non-modified or regular cable, causes the transfer of power from the headphones. A power management component connected to the internal power source of the headphones helps control or regulate the transfer of power transfer to and from the headphones.

18 Claims, 4 Drawing Sheets

(56) References Cited

U.S. PATENT DOCUMENTS

| | | | |
|---|---|---|---|
| 5,570,002 | A | 10/1996 | Castleman |
| 5,573,425 | A | 11/1996 | Morisawa et al. |
| 5,593,323 | A | 1/1997 | Dernehl |
| 5,615,344 | A | 3/1997 | Corder |
| 5,694,024 | A | 12/1997 | Dias et al. |
| 5,703,467 | A | 12/1997 | Patino |
| 5,783,926 | A | 7/1998 | Moon et al. |
| 5,836,783 | A | 11/1998 | Morisawa et al. |
| 5,861,729 | A | 1/1999 | Maeda et al. |
| 5,870,615 | A | 2/1999 | Bar-On et al. |
| 5,912,544 | A | 6/1999 | Miyakawa et al. |
| 5,939,856 | A | 8/1999 | Demuro et al. |
| 5,955,797 | A | 9/1999 | Kim |
| 5,969,438 | A | 10/1999 | Odaohara |
| 6,054,846 | A | 4/2000 | Castleman |
| 6,184,652 | B1 | 2/2001 | Yang |
| 6,288,522 | B1 | 9/2001 | Odaohhara et al. |
| 6,358,096 | B1 | 3/2002 | Beckman |
| 6,360,177 | B1 | 3/2002 | Curt et al. |
| 6,368,155 | B1 | 4/2002 | Bassler et al. |
| 6,459,175 | B1 | 10/2002 | Potega |
| 6,528,970 | B1 | 3/2003 | Liu et al. |
| 6,597,565 | B1 | 7/2003 | Kluth et al. |
| 6,628,535 | B1 | 9/2003 | Wu |
| 6,751,109 | B2 | 6/2004 | Doss et al. |
| 6,795,302 | B2 | 9/2004 | Kluth et al. |
| 6,903,950 | B2 | 6/2005 | Afzal et al. |
| 6,928,310 | B2 | 8/2005 | Lee |
| 6,999,505 | B2 | 2/2006 | Yokoo et al. |
| RE39,036 | E | 3/2006 | Castleman |
| 7,028,202 | B2 | 4/2006 | Long et al. |
| 7,039,821 | B1 | 5/2006 | Potega |
| 7,127,623 | B2 | 10/2006 | Potega |
| 7,145,312 | B2 | 12/2006 | Lanni |
| 7,158,815 | B2 | 1/2007 | Roh |
| 7,392,099 | B2 | 6/2008 | Atkinson et al. |
| 7,392,410 | B2 | 6/2008 | Allen et al. |
| 7,453,171 | B2 | 11/2008 | Lanni |
| 7,541,776 | B2 | 6/2009 | Tupman et al. |
| 7,548,040 | B2 | 6/2009 | Lee et al. |
| 7,868,486 | B2 | 1/2011 | Lanni |
| 7,937,603 | B2 | 5/2011 | Haberle et al. |
| 7,999,412 | B2 | 8/2011 | Lanni |
| 8,019,096 | B2 | 9/2011 | Sander et al. |
| 8,086,281 | B2 | 12/2011 | Rabu et al. |
| 8,090,132 | B2 | 1/2012 | Tang et al. |
| 8,155,367 | B2 | 4/2012 | Singh |
| 8,214,545 | B2 | 7/2012 | Khan et al. |
| 8,269,453 | B2 | 9/2012 | Ludtke |
| 8,295,532 | B2 | 10/2012 | Hsu et al. |
| 8,330,303 | B2 | 12/2012 | Lanni |
| 8,492,933 | B2 | 7/2013 | Lanni |
| 2002/0147036 | A1 | 10/2002 | Taguchi et al. |
| 2002/0171980 | A1 | 11/2002 | Tsukihashi |
| 2003/0157974 | A1 | 8/2003 | Lin |
| 2003/0207603 | A1 | 11/2003 | Potega |
| 2003/0222503 | A1 | 12/2003 | Lam et al. |
| 2004/0012368 | A1 | 1/2004 | Massey et al. |
| 2004/0075419 | A1 | 4/2004 | Massey et al. |
| 2004/0217733 | A1* | 11/2004 | Liu et al. ..... 320/114 |
| 2005/0024030 | A1 | 2/2005 | Lanni |
| 2005/0127758 | A1 | 6/2005 | Atkinson et al. |
| 2005/0151511 | A1 | 7/2005 | Chary |
| 2005/0162020 | A1 | 7/2005 | Lanni |
| 2005/0280398 | A1* | 12/2005 | Lee et al. ..... 320/134 |
| 2006/0164061 | A1 | 7/2006 | Formenti et al. |
| 2006/0220465 | A1 | 10/2006 | Kingsmore et al. |
| 2007/0072649 | A1 | 3/2007 | Park |
| 2008/0125164 | A1* | 5/2008 | Singh ..... 455/550.1 |
| 2008/0180874 | A1 | 7/2008 | Gauger et al. |
| 2009/0011793 | A1 | 1/2009 | Pocrass |
| 2009/0023480 | A1 | 1/2009 | Nandi et al. |
| 2009/0180642 | A1 | 7/2009 | Sander et al. |
| 2009/0323975 | A1* | 12/2009 | Groesch ..... 381/71.1 |
| 2010/0298029 | A1 | 11/2010 | Jang |
| 2011/0145445 | A1 | 6/2011 | Malamant et al. |
| 2011/0170702 | A1 | 7/2011 | Bays |
| 2011/0286615 | A1 | 11/2011 | Olodort et al. |
| 2012/0224710 | A1 | 9/2012 | Terlizzi et al. |
| 2013/0320913 | A1 | 12/2013 | Chen |

OTHER PUBLICATIONS

Linear Technology Corporation, "Applications Information," LTC4160/LTC4160-1, 2009; http://cds.linear.com/docs/Datasheet/41601fa.pdf.

Wata Electronics Co., Ltd., Design Model Chart, Oct. 11, 2012.

Utility U.S. Appl. No. 13/760,765, filed Feb. 6, 2013.

Compaq Computer Corporation, et al. "Universal Serial Bus Specification" Revision 2.0, Apr. 27, 2000.

Kickstarter, "Jump—The First Charging Solution That Fits Your Lifestyle," available at http://www.kickstarter.com/projects/nativeunion/jump-the-first-charging-solution-that-fits-your-li (last accessed Jan. 9, 2014).

* cited by examiner

POWER TRANSFERRING HEADPHONES

CROSS-REFERENCE TO RELATED APPLICATION

This application claims the benefit of and priority to U.S. patent application Ser. No. 13/760,765, filed on Feb. 6, 2013, the entire contents of which are incorporated by reference herein.

FIELD

The present disclosure generally relates to headphones which transfer electrical power from the headphones to an external device.

SUMMARY

In an exemplary embodiment, a pair of headphones may include a left speaker unit including a left speaker for providing audio output; a right speaker unit including a right speaker for providing audio output; an adjustable band configured to hold the left speaker unit and the right speaker unit; a port located on one of the speaker units, the port operatively connected to an internal power source of the headphones; and a power management component for regulating the internal power source of the headphones so that when a first cable is connected to the port and to an external device electrical power is transferred to the external device, and when a power adaptor is connected to the port and to a wall outlet, the internal power source is being charged.

In some exemplary embodiments, the data pin of the connecting end of the first cable may be electrically grounded.

In some exemplary embodiments, the first cable may also include a removable adaptor at the end of the first cable connecting to the port, the connector electrically grounding a data pin of the first cable.

In some exemplary embodiments, the power management component of the headphones may determines the amount of power in the internal power source and prevents the transfer of power from the internal power source if the amount of power is less than or equal to a predefined threshold power level.

In some exemplary embodiments, the integral power source may be one or more rechargeable batteries.

In some exemplary embodiments, the power management component may be a power manager integrated circuit. For example, the integrated circuit may be a Linear Chip LTC4160.

In some exemplary embodiments, port may be a USB type port and the first cable may be a USB type cable. For example, the USB port may be a micro USB port and the USB type cable can have at least one micro USB type connector.

In some exemplary embodiments, the power adaptor may include a removable cable.

In exemplary embodiments, a pair of headphones may include a left speaker unit including a left speaker for providing audio output; a right speaker unit including a right speaker for providing audio output; an adjustable band configured to hold the left speaker unit and the right speaker unit; a first port located on one of the speaker units, the first port electrically connected to an internal power source of the headphones; a second port located one of the speaker unit, the second port electrically connected to the internal power source of the headphones; and a power management component for regulating the internal power source of the headphones so that when a first cable is connected to the first port and to an external device electrical power is transferred to the external device, and when a power adaptor is connected to the second port and to a wall outlet, the internal power source is being charged.

In some exemplary embodiments, one of the ports may be a USB port and the other port may be a micro USB port.

DESCRIPTION OF THE DRAWINGS

The features and advantages of the present disclosure will be more fully understood with reference to the following, detailed description when taken in conjunction with the accompanying figures, wherein.

DETAILED DESCRIPTION

Figure 1:
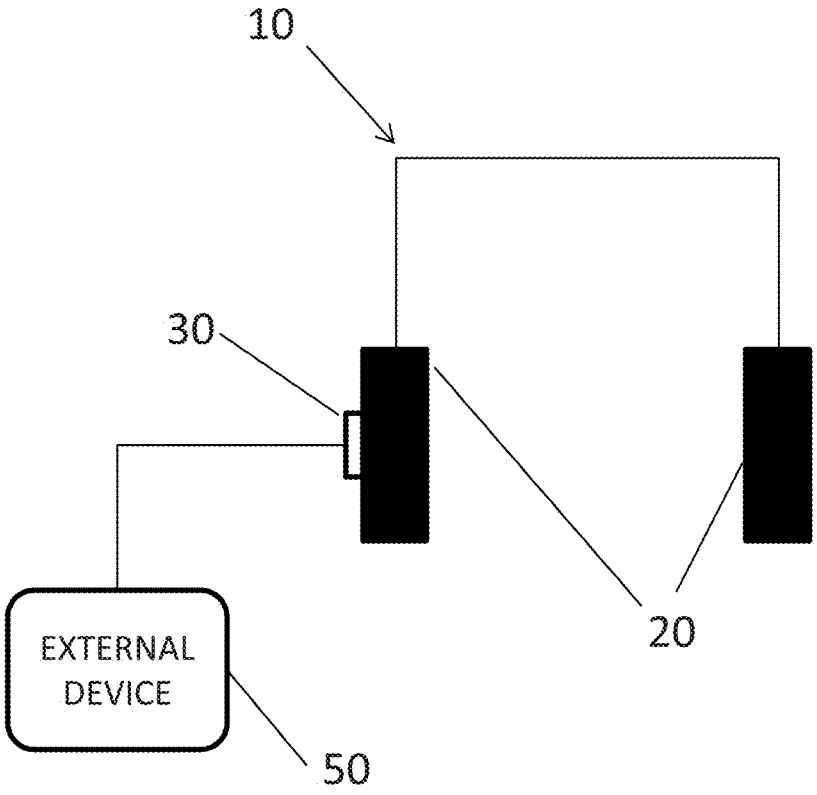
FIG. 1 illustrates a pair of headphones connected to an external device according to an exemplary embodiment of the present invention.

The present disclosure generally relates to methods for transferring electrical power from a pair of headphones to an external device. The drawing figures are not necessarily drawn to scale and certain figures may be shown in exaggerated or generalized form in the interest of clarity and conciseness.

FIG. 1 illustrates a diagram illustrating a pair of headphones connected to an external device, according to an exemplary embodiment. The headphones 10 can include one or more batteries, which can be disposable or rechargeable. In embodiments, the headphones may also include other features or functionalities, including amplifiers, Bluetooth, noise cancellation circuitry, a power management device, etc. The headphones 10, are illustrated as being full size headphones, but any other battery powered headphones may be used herein.

Referring to FIG. 1, the headphones 10 connect to an external device 50 via a communication port 30 in accordance with exemplary embodiments. The external device may be any device, such as, for example mobile phones, smartphones (e.g., iPhone®, Android® devices, Blackberry® devices, Windows, etc.), tablets devices (e.g., iPad®, iPad® Mini, Android® tablet, Surface™, ChromeBook, etc.), laptops, desktops, portable music players (e.g., iPod, iPodTouch, etc.), etc.

In embodiments, the headphones 10 can communicate data, and/or exchange electrical power via the port 30. As shown, the port 30 is integrated with a speaker 120. However this is not necessary as the port 30 can be located in any suitable location on the headphones.

Figure 2:
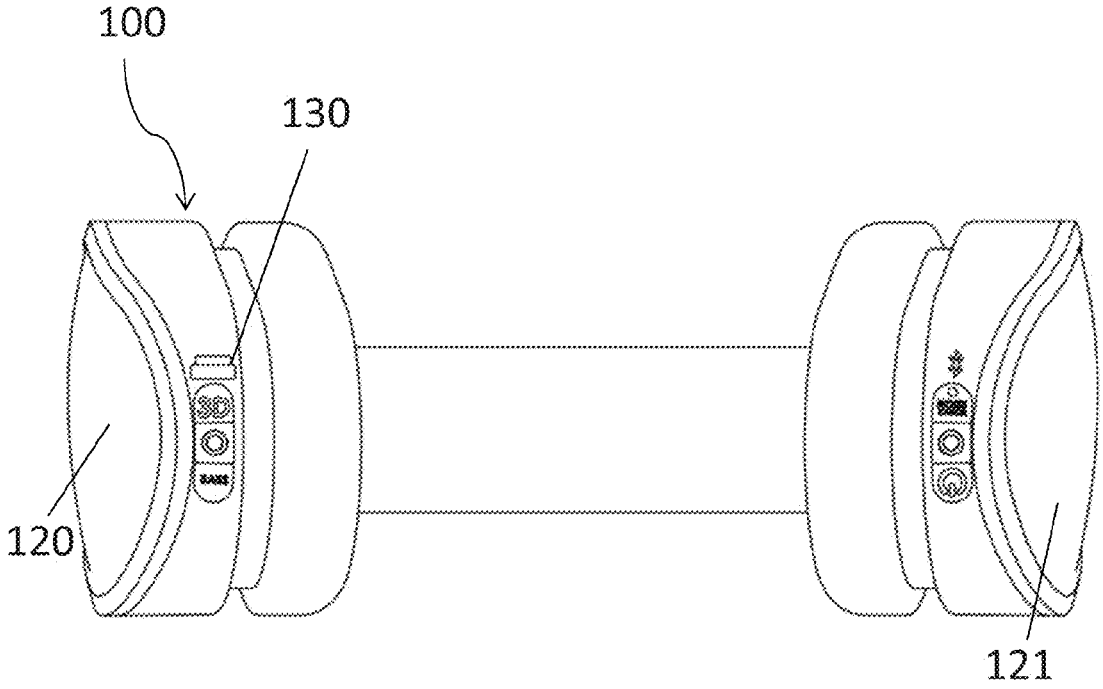
FIG. 2 illustrates a pair of headphones according to an exemplary embodiment of the present invention.

FIG. 2 illustrates, according to an exemplary embodiment, a pair of headphones 100 include a micro USB port 130 which can be used to charge the headphones (using a standard charge cable) and to charge other external devices. As shown, the port 130 is integrated in one of the speakers 120. The port 30, can be electrically directly or indirectly connected to the batteries of the headphones. In exemplary embodiments, other ports can be used in lieu of a micro USB port or other USB port as discussed herein.

In exemplary embodiments, the flow of electrical power from the headphones 100 to an external device is facilitated or accomplished through the use of a specialized or modified cable. FIG. 2, shows, according to an exemplary embodiment, a modified USB cable 200. The cable 200 has a connector 210 for connecting to the headphones and an external connector 220 for connecting to an external device. In some embodiments, the connectors 210, 220 may be a micro USB type connector (because the headphones have a micro USB port), but cables with other types of connectors may be used in accordance with the embodiments described herein. In embodiments, the cable 200 may be modified such that at least one data pin of the connector is grounded. Other modifications can be made to the cable to enable a power management component (as discussed below) to distinguish between a charging cable and a discharging cable. The connection of cable to the headphones and to an external device causes electrical power to be transferred from the headphones to the electrical device.

Figure 3:
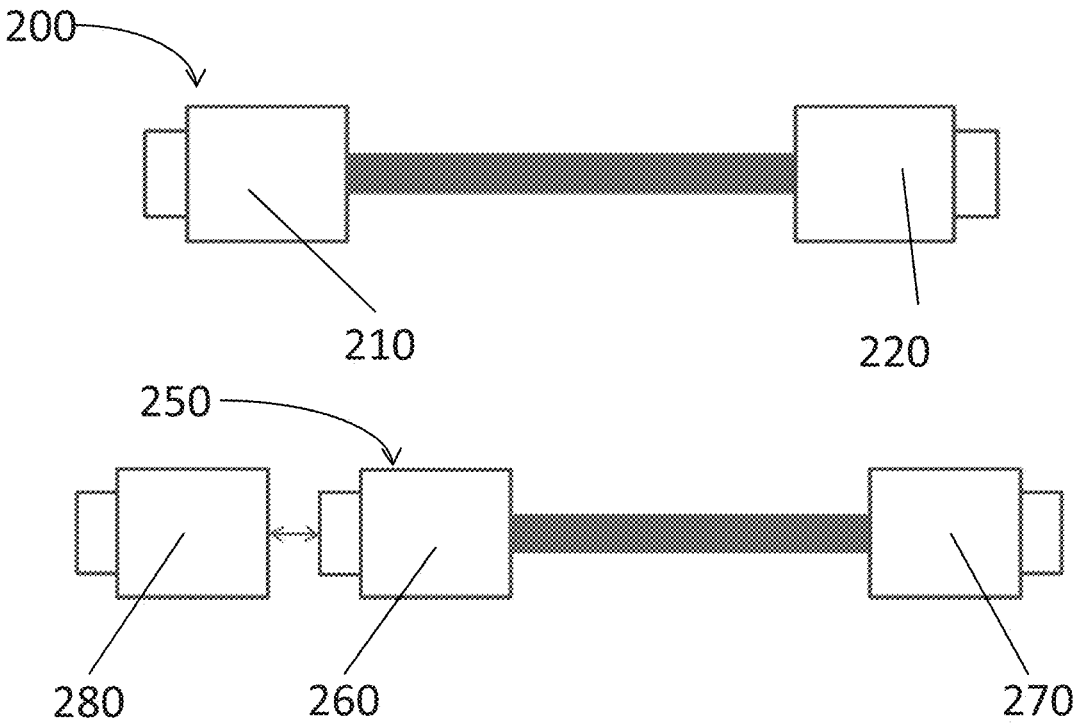
FIG. 3 illustrates cables used for transferring power according to an exemplary embodiment of the present invention.

In some exemplary embodiments, instead of using a modified USB cable to facilitate the transfer of power to an external device, a regular cable, (e.g., a standard USB type cable and the like) with an adaptor can be used. For example, referring to FIG. 3, a standard USB type cable 250 with regular male USB connectors 260, 270 may connect to the headphones via the adaptor 280. For example, the adaptor 280 has a male USB connector and can receive or attach to another male USB connector, such as connector 260.

In embodiments, the wires or connectors of the adaptor 280 can be modified or wired in order to effectively ground the data pin of the cable 250, in order to cause the headphones to provide electrical power to the USB device. Thus, in order to transfer power from the headphones, the adaptor 280 can be arranged to connect to the USB port 130 of the headphones at one end and connect to one of the connectors 260, 270 of the cable 250 at the other end. The connector of the cable not attached to the adaptor 280 connects to the external device. Other modifications can be made to the adaptor to enable the power management component (as discussed below) to distinguish between a charging operation and a discharging operation.

Figure 4:
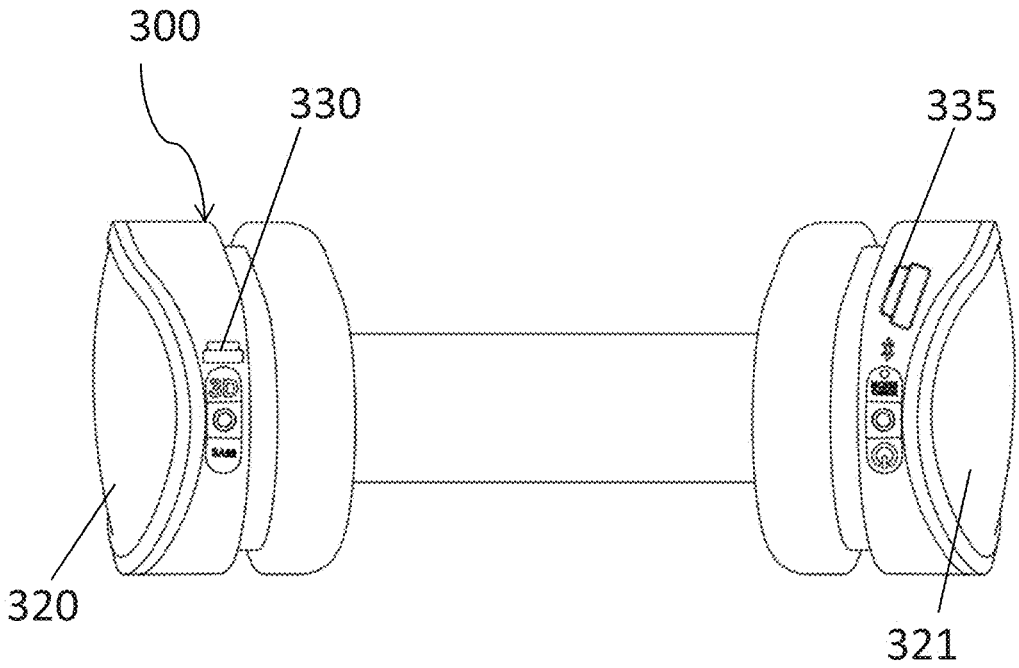
FIG. 4 illustrates a pair of headphones according to an exemplary embodiment of the present invention.

In exemplary embodiments, in order facilitate power from headphones to an external device, the headphones may include a modified port. For example, referring to FIG. 4, the headphones 300 have a micro USB port 330 built into speaker 320 and a regular USB port 335 built into speaker 321. The ports 330, 335 do not necessarily have to be incorporated on separate speaker or speaker unit. Further, at least one of the ports 330, 335 can be modified so as to effectively modify a data pin of a connecting cable. Other modifications can be made to the ports to enable a power management component (as discussed below) to distinguish between a charging port and a discharging port. Therefore when a cable connects to the modified port and to an external device, electrical power transfers from the headphones to the external device. The unmodified port can be used in accordance with other functions of the headphones, e.g., charge the headphone, update firmware, etc.

In exemplary embodiments, the headphones described herein can further include a power management component (not shown). The power management component can interface between the USB port used for transferring power and the battery source of the headphones. In this regard the power management component may include an integrated circuit such as Linear Chip LTC4160. The Specification for the Linear Chip LTC4160 (Switching Power Manager with USB On-The-Go And Overvoltage Protection available at <http://cds.linear.com/docs/Datasheet/41601fa.pdf>) and is hereby incorporated by reference as if set forth herein.

In exemplary embodiments, the power management component may be used to safeguard the headphones from being excessively drained. In other words, the power management component may prevent the transfer of electrical power once the power level of the headphones battery source reaches or dips below a threshold value, for example (20% of the battery power capacity).

In some exemplary embodiments, the power management component may also control or regulate how fast electrical power is transferred from the headphones.

In some exemplary embodiments, the headphones may include an attached or affixed connector, such as a USB connector. In some embodiments, such a connector may be retractable. For example the cable/wire attached to such a USB connector may be capable of retracting into the interior of the headphones. In some exemplary embodiments, the connector (e.g., USB connector) may be attached headphones so as to be able to swivel. In this regard, the connector may swivel or conveniently fold next or into the headphones, or a portion thereof. Such connectors (e.g., retractable and/or swivel connectors) may be utilized, modified, and/or implemented in accordance with the embodiments described herein, e.g., in order to facilitate transferring power and/or data to and from the headphones.

It will be understood that that any of the above steps and/or elements can be combined, separated, in any combination and/or separation thereof, and/or taken in any order. For ease, the steps are described as being sequential and/or in order. This is merely for ease and is not in any way meant to be a limitation.

Now that exemplary embodiments of the present disclosure have been shown and described in detail, various modifications and improvements thereon will become readily apparent to those skilled in the art.

What is claimed:

1. A pair of headphones comprising:

a left speaker unit including a left speaker for providing audio output;

a right speaker unit including a right speaker for providing audio output;

an adjustable band configured to hold the left speaker unit and the right speaker unit;

a port located on one of the speaker units, the port operatively connected to an internal power source of the headphones; and an internal power management component for regulating the internal power source of the headphones and controlling an output voltage of the internal power source so that when electrical power is provided by the internal power source to a function of the headphones and a first cable is connected to the port and to an external device, electrical power is also transferred from the headphones to the external device, and when a power adaptor is connected to the port and to a wall outlet, the internal power source is being charged.

2. The headphones of claim 1, wherein a data pin of the connecting end of the first cable is electrically grounded.

3. The headphones of claim 1, wherein the first cable further comprises a removable adaptor at the end of the first cable connecting to the port, the connector electrically grounding a data pin of the first cable.

4. The headphones of claim 1, wherein the power management component determines the amount of power in the internal power source and prevents the transfer of power from the internal power source if the amount of power is less than or equal to a predefined threshold power level.

5. The headphones of claim 1, wherein the internal power source is one or more rechargeable batteries.

6. The headphones of claim 1, wherein the power management component comprises a power manager integrated circuit.

7. The headphones of claim 6, wherein the integrated circuit is a Linear Chip LTC4160.

8. The headphones of claim 1, wherein the port is a USB type port and the first cable is a USB type cable.

9. The headphones of claim 8, wherein the USB type port is a micro USB port and the USB type cable has at least one micro USB type connector.

10. The headphones of claim 1, wherein the power adaptor comprises a removable cable.

11. A pair of headphones comprising:

a left speaker unit including a left speaker for providing audio output;

a right speaker unit including a right speaker for providing audio output;

an adjustable band configured to hold the left speaker unit and the right speaker unit;

a first port located on one of the speaker units, the first port electrically connected to an internal power source of the headphones;

a second port located one of the speaker units, the second port electrically connected to the internal power source of the headphones; and an internal power management component for regulating the internal power source of the headphones so that electrical power is provided by the internal power source to a function of the headphones and when a first cable is connected to the first port and to an external device electrical power is also transferred from the headphones to the external device, and when a power adaptor is connected to the second port and to a wall outlet, the internal power source is being charged.

12. The headphones of claim 11, wherein the first port is configured to electrically ground a data pin of a cable connecting thereto.

13. The headphones of claim 11, wherein the power management component determines the amount of power in the internal power source and prevents the transfer of power from the internal power source if the amount of power is less than or equal to a predefined threshold power level.

14. The headphones of claim 11, wherein the internal power source is one or more rechargeable batteries.

15. The headphones of claim 11, wherein the power management component comprises a power manager integrated circuit.

16. The headphones of claim 15, wherein the integrated circuit is a Linear Chip LTC4160.

17. The headphones of claim 11, wherein one of the ports is a USB port and the other port is a micro USB port.

18. The headphones of claim 11, wherein the power adaptor comprises a removable cable.

* * * * *